US010714064B1

(12) United States Patent
Hafner

(10) Patent No.: US 10,714,064 B1
(45) Date of Patent: Jul. 14, 2020

(54) INSTRUMENT SUPPORT STRAP WITH COOLING FEATURE

(71) Applicant: Karl Hafner, Chicago, IL (US)

(72) Inventor: Karl Hafner, Chicago, IL (US)

( * ) Notice: Subject to any disclaimer, the term of this patent is extended or adjusted under 35 U.S.C. 154(b) by 0 days.

(21) Appl. No.: 16/570,823

(22) Filed: Sep. 13, 2019

(51) Int. Cl.
*G10G 5/00* (2006.01)

(52) U.S. Cl.
CPC ..... *G10G 5/005* (2013.01)

(58) Field of Classification Search
CPC ..... G10G 5/005
See application file for complete search history.

(56) References Cited

U.S. PATENT DOCUMENTS 6,398,092 B1 * 6/2002 Ansley ..... A45F 5/02 224/582
D711,963 S * 8/2014 Gilmore ..... D17/20

FOREIGN PATENT DOCUMENTS

KR 20050018465 A * 2/2005 ..... A41D 13/005

* cited by examiner

*Primary Examiner* — Kimberly R Lockett

(57) ABSTRACT

A cooling accessory for attachment to a strap to support a musical instrument is disclosed. The cooling accessory includes a pouch and a coolant pack held in the pouch. A rear surface holds the pouch. The rear surface has opposite ends. An attachment device is located on each of the opposite ends to attach the cooling accessory to the strap.

13 Claims, 5 Drawing Sheets

INSTRUMENT SUPPORT STRAP WITH COOLING FEATURE

TECHNICAL FIELD

This disclosure relates to accessories for musical instruments, and more specifically to a support strap that cools a musician when worn.

BACKGROUND

Musicians such as guitarists often exert energy in performances as they move around on stage when performing. Such performances may last for longer than two hours and thus musicians often perspire profusely during this time. The exertion required may be compounded by hot stage conditions in confined spaces or in hot temperature outdoor venues. Further, the weight of carrying around an instrument may cause shoulder or other pain over the course of a performance. Often musicians will lose focus due to the effects of heat during their performances.

Musicians often will have water or other beverages available to cool themselves. However, such beverages must be made available or replenished during a performance. Musicians must remember to hydrate, which creates additional distractions during performances. Another solution is to place a cooling towel on the shoulder. This solution is less than ideal, since the towel sometime falls off the musician during stage movement. Further, this is often a temporary solution as the towel has limited heat absorption capability.

Thus, there is a need for a device to cool a musician during a performance. There is also a need for a device that can be adapted to an existing musical instrument strap to cool a musician. There is a further need for a cooling device that provides relief for shoulder pain from supporting an instrument.

BRIEF SUMMARY

One disclosed example is a cooling accessory for attachment to a strap to support a musical instrument. The cooling accessory includes a pouch and a coolant pack held in the pouch. The cooling accessory has an interior surface holding the pouch. The interior surface has opposite ends. An attachment device is provided on each of the opposite ends to attach the cooling accessory to the strap.

Another disclosed example is an instrument strap for cooling a musician. The instrument strap includes a body having opposite ends each attachable to a musical instrument. The body includes an interior surface in contact with the musician when worn and an opposite exterior surface. The strap includes a pouch on the interior surface and a coolant pack in the pouch.

The foregoing and additional aspects and implementations of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

Figure 1A:
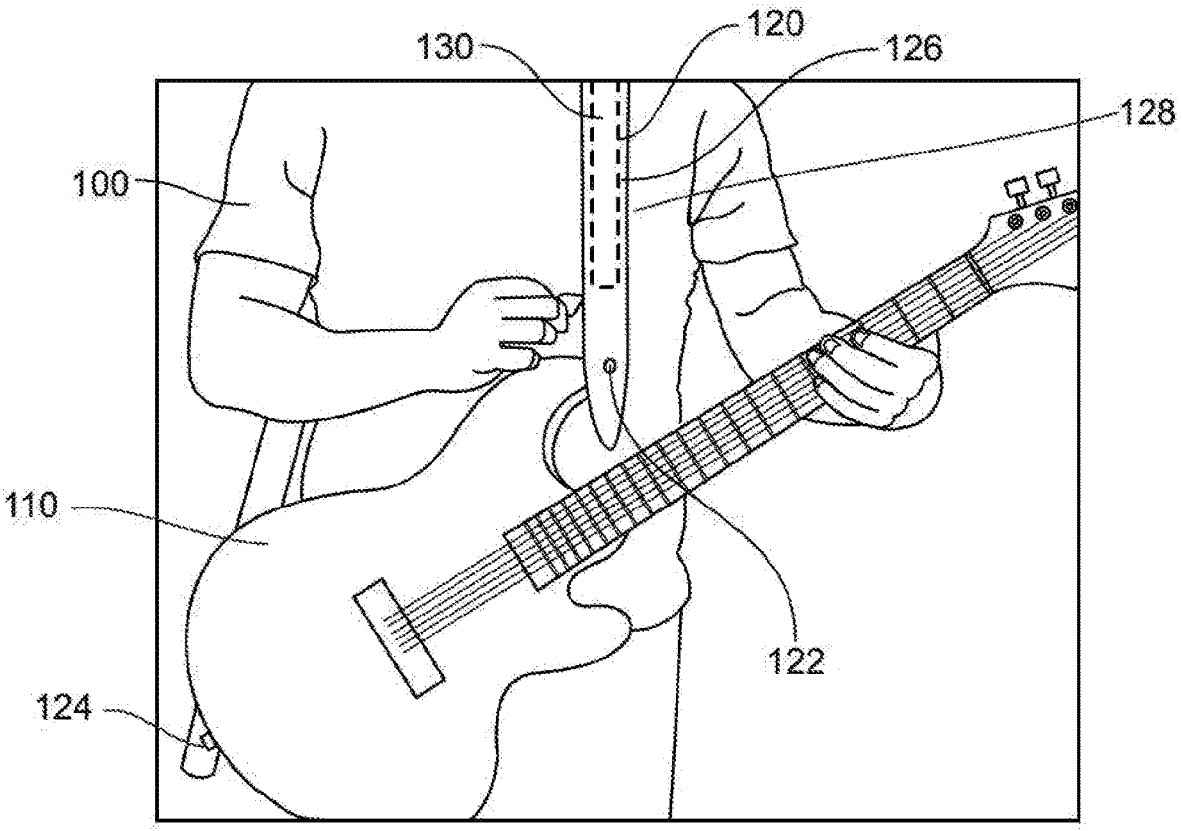
FIG. 1A is a front view of a guitarist using an example strap with a cooling accessory.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

The present inventions can be embodied in many different forms. Representative embodiments are shown in the drawings, and will herein be described in detail. The present disclosure is an example or illustration of the principles of the present disclosure, and is not intended to limit the broad aspects of the disclosure to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference, or otherwise. For purposes of the present detailed description, unless specifically disclaimed, the singular includes the plural and vice versa; and the word "including" means "including without limitation." Moreover, words of approximation, such as "about," "almost," "substantially," "approximately," and the like, can be used herein to mean "at," "near," or "nearly at," or "within 3-5% of," or "within acceptable manufacturing tolerances," or any logical combination thereof, for example.

Figure 1B:
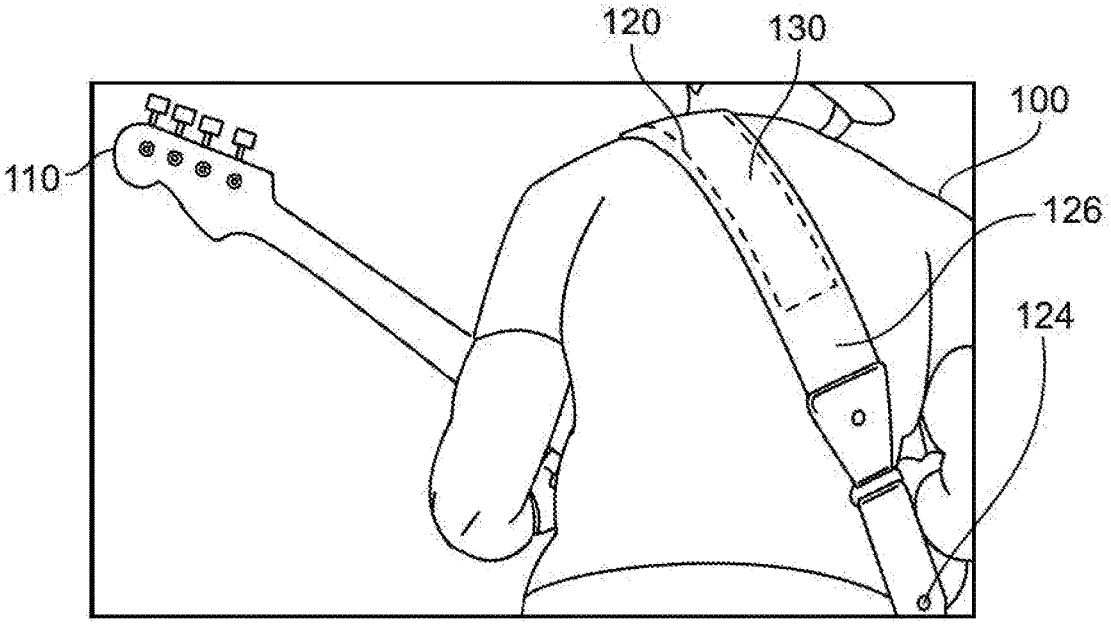
FIG. 1B is a rear view of the guitarist using the example strap with the cooling accessory in FIG. 1A.

FIG. 1A is a front perspective view of a musician 100 who is playing a musical instrument 110 that is suspending by a strap 120 attached to the musical instrument 110. In this example, the musical instrument 110 is a guitar, but other instruments, such as bass guitars, banjos, mandolins, tubas, bassoons, or saxophones may require a strap similar to the strap 120. In this example, the strap 120 has a first end 122 that is attached to one part of the instrument 110. FIG. 1B is a back perspective view of the musician 100 showing an opposite end 124 of the strap 120 attached to another part of the musical instrument 110. The attachment points of the ends 122 and 124 allow the musician 100 to support the musical instrument without their hands. The strap 120 has an exterior side 126 and an opposite interior side 128 that is typically in proximity to the body of the musician 100.

In this example, a cooling accessory 130 is attached to the strap 120. The cooling accessory 130 is suspended by the strap 120 to be in contact with the body of the musician 100. The cooling accessory 130 provides cooling to the body of the musician 100 when the strap 120 supports the musical instrument 110.

Figure 2:
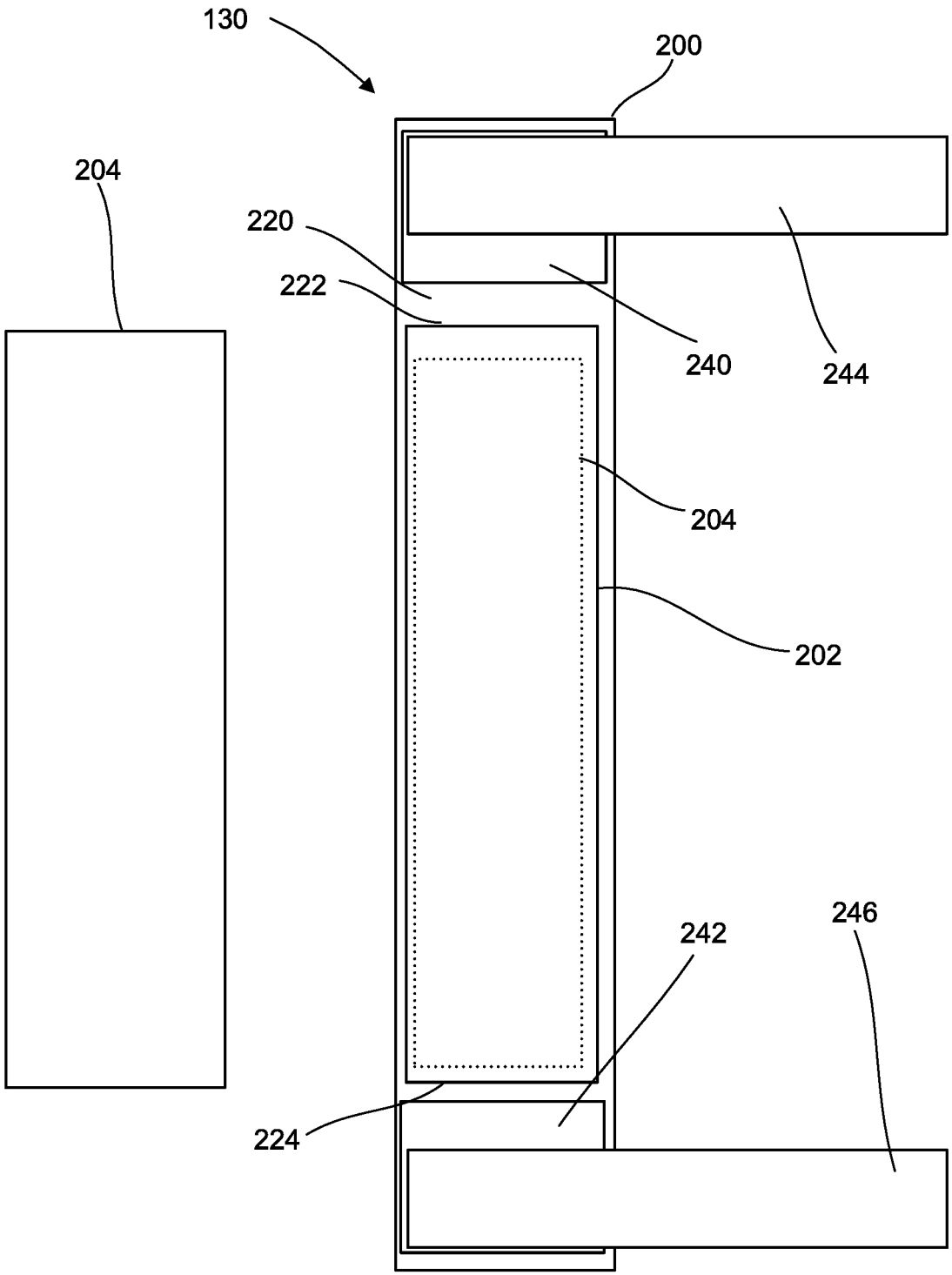
FIG. 2 is a rear view of the cooling accessory in FIG. 1A.
Figure 3A:
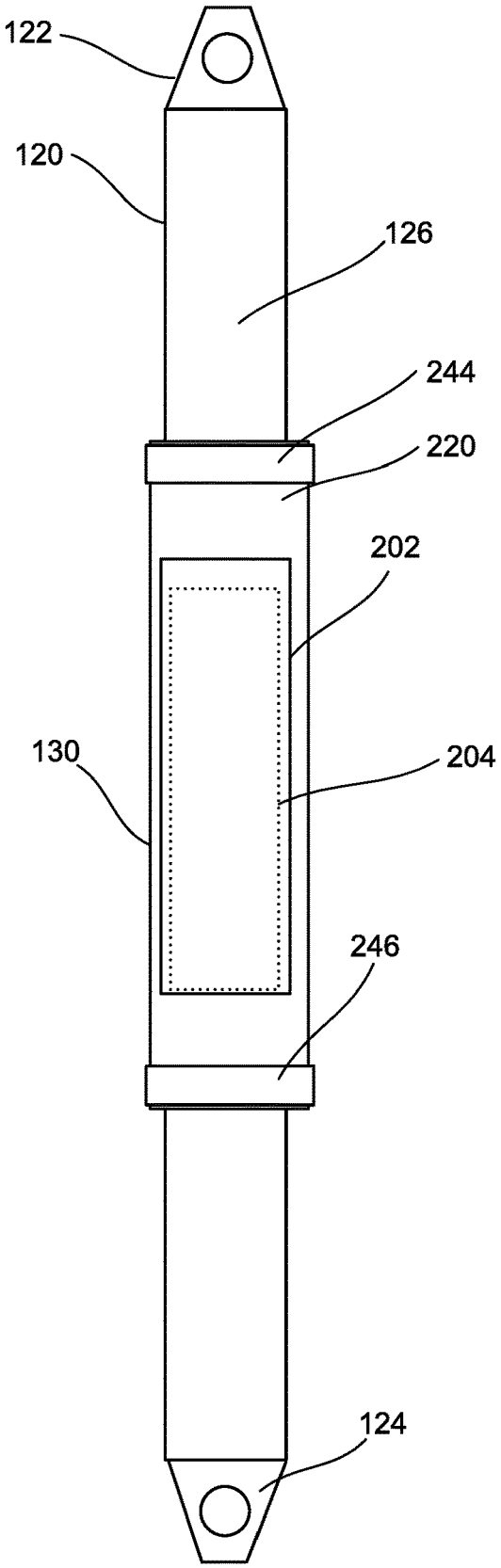
FIG. 3A is a front view of an example instrument strap with the cooling accessory in FIG. 1A.
Figure 3B:
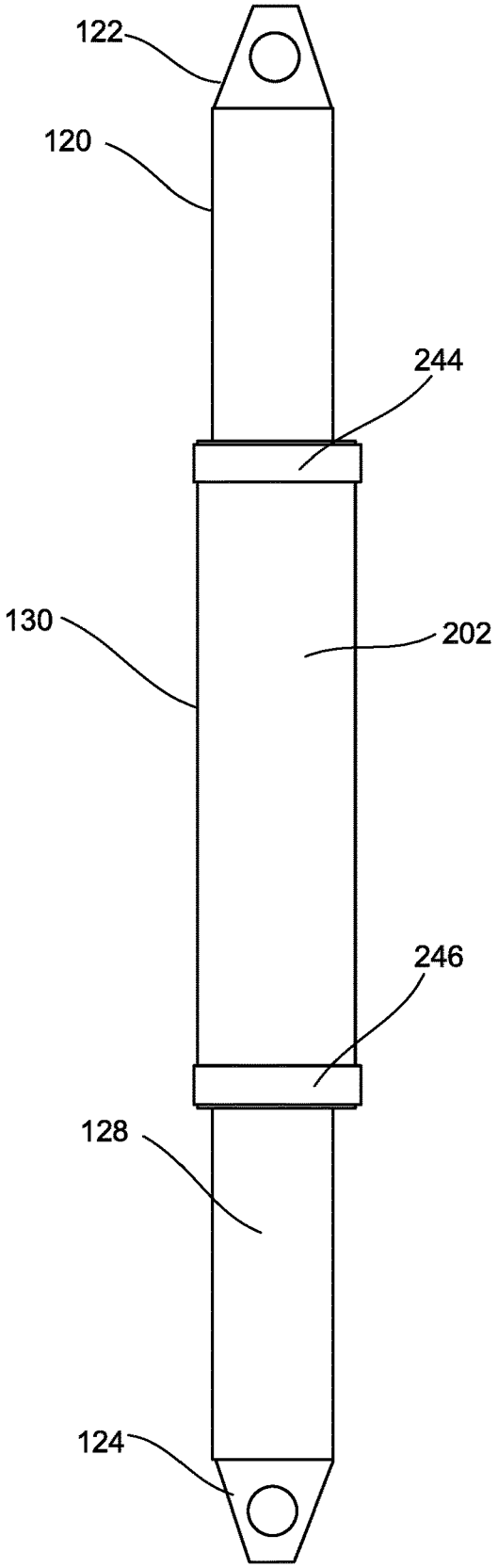
FIG. 3B is a rear view of the example instrument strap with the cooling accessory in FIG. 1A.

FIG. 2 shows the cooling accessory 130 in FIG. 1 detached from the strap 120. FIG. 3A shows a close up view of the front of the instrument strap 120 with the attached cooling accessory 130. FIG. 3B shows a close up view of the back of the instrument strap 120 with the attached cooling accessory 130.

The cooling accessory 130 includes a main body 200 that has a tube 202 for holding a cold pack 204. The cooling accessory 130 includes a rear surface 220 that is attached to the tube 202. The tube 302 has an open end 222 and a closed end 224 and thus forms a pouch like structure in conjunction with the rear surface 220. The open end 222 allows the cold pack 204 to be inserted into the tube 202. The cold pack 204 may be held in the tube 202 by an attachment device such as a zipper, a snap, a magnetic fastener, or a Velcro patch that allows attaching the edge of the open end 222 to the rear surface 220.

Each end of the rear surface 220 includes a respective attachment patch 240 and 242. The attachment patches 240 and 242 are Velcro. Respective straps 244 and 246 are attached to the patches 240 and 242. The straps 244 and 346 are wrapped around the instrument strap 120 as shown in FIGS. 3A-3B to hold the accessory 130 on the strap 120.

In this example, the tube 202 may be nylon, but any heat transferable and liquid resistant material may be used. The cold pack 204 may be an ice pack. Alternatively, the cold pack 304 may be a coolant package such as a cryo pack that may be frozen for use. After use, the cold pack 304 may be refrozen and reused.

The cooling accessory 130 keeps a musician cool when wearing the accessory 130 suspending on an instrument strap such as the strap 110. This allows a musician to perform in greater comfort. Further, the cooling accessory 130 allows relief from shoulder pain from suspending the instrument 110 via the strap 120 for prolonged periods of time.

Figure 4:
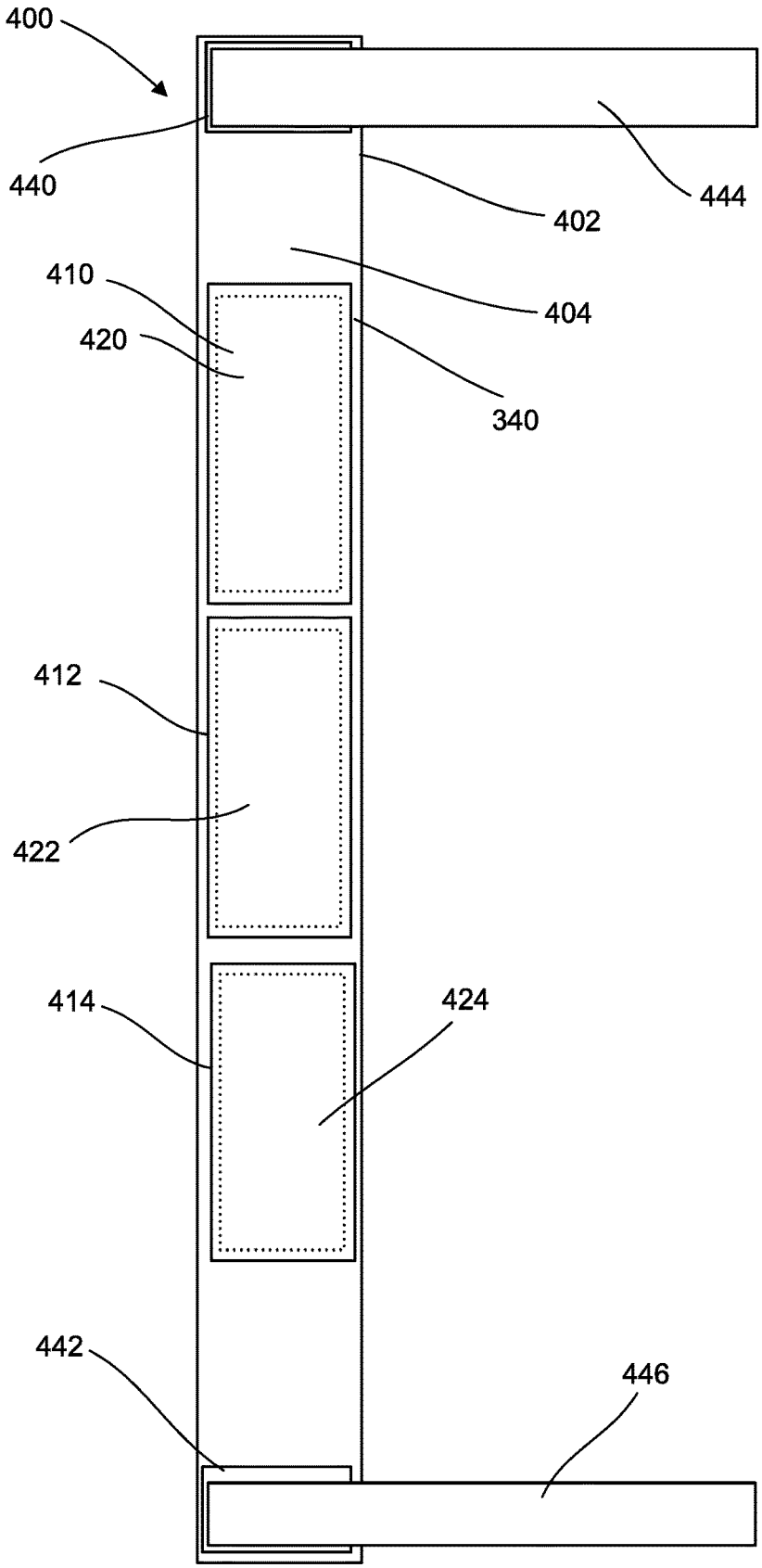
FIG. 4 is a front perspective view of another example cooling accessory for attachment to an instrument strap.

FIG. 4 shows an alternative cooling accessory 400 that may be attached to an instrument strap. The cooling accessory 400 includes a front surface 402 and an opposite rear surface 404. The rear surface 404 includes separate tubes 410, 412, and 414 for holding separate respective coolant packs 420, 422, and 424. The coolant pack 420 rests on the chest of the musician, the middle coolant pack 422 rests on the shoulder of the musician, and the coolant pack 424 rests on the back of the musician. Each of the coolant packs 420, 422, and 424 are held in place by the respective tubes 410, 412, and 414. Each of the tubes 410, 412, and 414 may have attachment devices to keep the respective packs 420, 422, and 424 in the tubes.

Each end of the rear surface 404 includes a respective attachment patch 440 and 442. The attachment patch 440 and 442 are Velcro. Respective straps 444 and 446 are attached to the patches 440 and 442. The straps 444 and 446 are wrapped around the instrument strap similar to the arrangement as shown in FIGS. 3A-3B to hold the accessory 130 on the strap 120.

Figure 5:
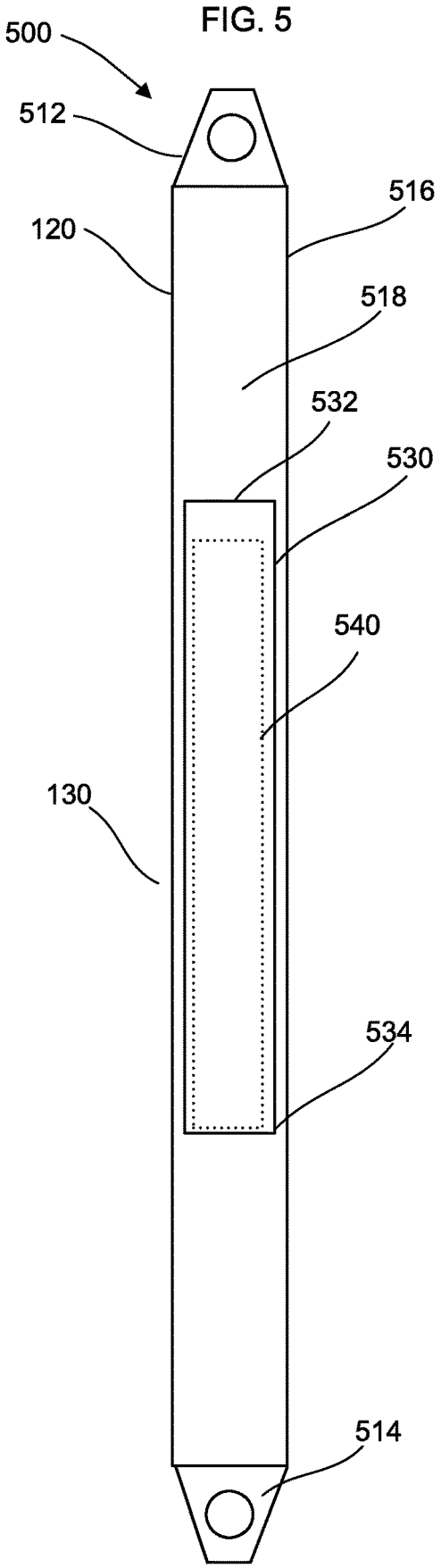
FIG. 5 is a front view of another example instrument strap with a built in cooling pack.

FIG. 5 is a front view of another example instrument strap 500 with a built in cooling pack. The example instrument strap 500 has a first end 512 that is attached to one part of an instrument such as the instrument 110 in FIG. 1A. The strap has an opposite end 514 that is attached to another point of the musical instrument to allow the musician to support the instrument when wearing the strap 500. The strap 500 has an exterior side 516 and an opposite interior side 518 that is typically worn in proximity to the body of the musician.

In this example, a tube 530 is attached to a length of the interior side 518. The tube 530 has a closed end 532 and an open end 534 to accept a cooling pack 540. The cooling pack 540 thus provides cooling through the tube 530 in contact with the body of the musician. The tube 530 has sufficient length to cover the back, chest and shoulder of the musician in this example.

Figure 6:
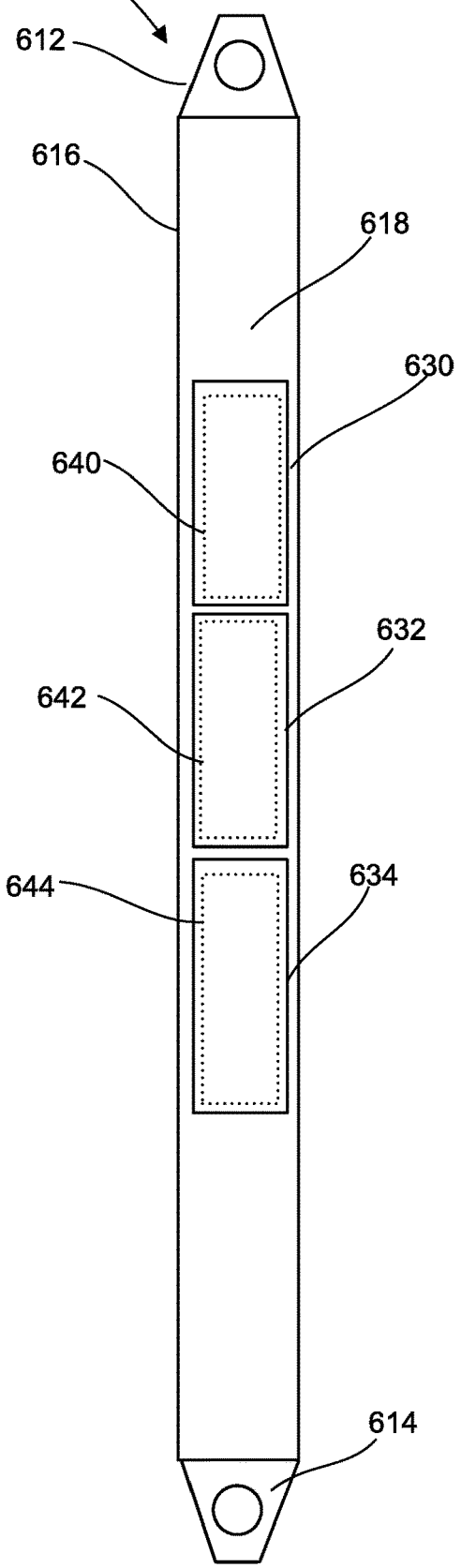
FIG. 6 is a front view of another example instrument strap with multiple built in cooling packs.

FIG. 6 is a front view of another example instrument strap 600 with multiple built in cooling packs. The example instrument strap 600 has a first end 612 that is attached to one part of an instrument such as the instrument 110 in FIG. 1A. The strap has an opposite end 614 that is attached to another point of the musical instrument to allow the musician to support the instrument when wearing the strap 600. The strap 600 has an exterior side 616 and an opposite interior side 618 that is typically worn in proximity to the body of the musician.

In this example, the interior surface 618 includes separate pouches 630, 632, and 634 for holding separate respective coolant packs 640, 642, and 644. The coolant pack 640 rests on the chest of the musician, the middle coolant pack 642 rests on the shoulder of the musician, and the coolant pack 644 rests on the back of the musician. Each of the coolant packs 640, 642, and 644 are held in place by the respective pouches 630, 632, and 634. Each of the pouches 630, 632, and 634 may have attachment devices to keep the respective packs 640, 642, and 644 in the pouches.

The terminology used herein is for the purpose of describing particular embodiments only, and is not intended to be limiting of the invention. As used herein, the singular forms "a," "an," and "the" are intended to include the plural forms as well, unless the context clearly indicates otherwise. Furthermore, to the extent that the terms "including," "includes," "having," "has," "with," or variants thereof, are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art. Furthermore, terms, such as those defined in commonly used dictionaries, should be interpreted as having a meaning that is consistent with their meaning in the context of the relevant art, and will not be interpreted in an idealized or overly formal sense unless expressly so defined herein.

While various embodiments of the present invention have been described above, it should be understood that they have been presented by way of example only, and not limitation. Although the invention has been illustrated and described with respect to one or more implementations, equivalent alterations and modifications will occur or be known to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. Thus, the breadth and scope of the present invention should not be limited by any of the above described embodiments. Rather, the scope of the invention should be defined in accordance with the following claims and their equivalents.

What is claimed is:

1. A cooling accessory for attachment to a strap to support a musical instrument, the cooling accessory comprising:

a pouch having opposite sides;

a coolant pack held in the pouch between the opposite sides;

rear interior surface holding one side of the pouch, the rear interior surface having opposite ends;

a front exterior surface opposite the rear interior surface, the front exterior surface in contact with an interior surface of the strap; and an attachment device on each of the opposite ends to attach the cooling accessory to the strap, wherein the side of the pouch opposite the side held by the rear interior surface is in contact with a musician when the musician wears the strap.

2. The cooling accessory of claim 1, wherein the attachment devices are straps attached to each other by velcro.

3. The cooling accessory of claim 1, wherein the coolant pack is an ice pack.

4. The cooling accessory of claim 1, wherein the coolant pack is a cryo pack.

5. The cooling accessory of claim 1, wherein the pouch includes an attachment mechanism to hold the coolant pack in the pouch.

6. The cooling accessory of claim 1, further comprising a second coolant pack in a second pouch on the interior surface.

7. The cooling accessory of claim 1, wherein the coolant pack is placed in contact with a shoulder of the musician when the strap is worn.

8. An instrument strap for cooling a musician, the instrument strap comprising:

a body having opposite ends each attachable to a musical instrument, wherein the body includes an interior surface in proximity with the musician when the instrument strap is worn and an opposite exterior surface;

a pouch having one side on the interior surface and an opposite side in contact with the musician when the instrument strap is worn; and a coolant pack held in the pouch between the two sides.

9. The instrument strap of claim 8, wherein the coolant pack is an ice pack.

10. The instrument strap of claim 8, wherein the coolant pack is a cryo pack.

11. The instrument strap of claim 8, wherein the pouch includes an attachment mechanism to hold the coolant pack in the pouch.

12. The instrument strap of claim 8, further comprising a second coolant pack in a second pouch on the interior surface of the body.

13. The instrument strap of claim 8, wherein the coolant pack is placed in contact with a shoulder of the musician when the strap is worn.

* * * * *